US009728358B2

(12) United States Patent
Henderson

(10) Patent No.: US 9,728,358 B2
(45) Date of Patent: Aug. 8, 2017

(54) MAGNETIC CONTROL DEVICES FOR ENCLOSURES

(71) Applicant: Lewis T. Henderson, Fayetteville, NY (US)

(72) Inventor: Lewis T. Henderson, Fayetteville, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/149,363

(22) Filed: May 9, 2016

(65) Prior Publication Data

US 2016/0254111 A1 Sep. 1, 2016

Related U.S. Application Data

(62) Division of application No. 14/026,583, filed on Sep. 13, 2013, now Pat. No. 9,355,800.

(51) Int. Cl.
*H01H 36/00* (2006.01)

(52) U.S. Cl.
CPC ..... *H01H 36/0073* (2013.01); *H01H 36/00* (2013.01); *H01H 36/004* (2013.01); *H01H 2223/002* (2013.01)

(58) Field of Classification Search
CPC .... H01H 36/0073; H01H 36/00; H01H 36/04; H01H 2036/0086
USPC ..... 335/205–207
See application file for complete search history.

(56) References Cited

U.S. PATENT DOCUMENTS

| | | | | |
|---|---|---|---|---|
| 2,333,547 A | | 11/1943 | Neumann | |
| 3,317,870 A | | 5/1967 | Bear | |
| 3,361,999 A | | 1/1968 | Leinauer et al. | |
| 3,529,269 A | | 9/1970 | Gardiner | |
| RE27,077 E | | 2/1971 | Bear | |
| 4,025,885 A | * | 5/1977 | Giannini | H01H 36/0073 335/154 |
| 4,117,431 A | | 9/1978 | Eicher | |

(Continued)

FOREIGN PATENT DOCUMENTS

| | | |
|---|---|---|
| DE | 1141000 | 12/1962 |
| RU | 2028019 | 1/1995 |

OTHER PUBLICATIONS

Doroshenko, I., International Search Report and Written Opinion of the International Searching Authority for PCT/US2014/055238, completed on Nov. 26, 2014, mailing date Dec. 11, 2014, pp. 1-6.

*Primary Examiner* — Ramon M Barrera
(74) *Attorney, Agent, or Firm* — King & Spalding LLP

(57) ABSTRACT

A control device for an enclosure is disclosed, where the control device includes a first portion positioned proximate to a back side of an enclosure surface of the enclosure, and a second portion positioned proximate to a front side of the enclosure surface. The first portion can include a plunger having a proximal end and a distal end, where the proximal end is adjacent to the enclosure surface. The first portion can also include a first magnet having a first polarity and disposed at the proximal end of the plunger. The first portion can further include at least one contact in communication with the distal end of the plunger, where the at least one contact has a first state and a second state. The second portion can include a second magnet having a second polarity, where the second magnet has an engaged position and a disengaged position.

20 Claims, 6 Drawing Sheets

(56) References Cited

U.S. PATENT DOCUMENTS

| | | | |
|---|---|---|---|
| 4,663,601 | A | 5/1987 | Troutman et al. |
| 4,837,539 | A | 6/1989 | Baker |
| 5,278,543 | A | 1/1994 | Orth et al. |
| 5,877,664 | A | 3/1999 | Jackson, Jr. |
| 6,545,576 | B1 | 4/2003 | Marchini et al. |
| 6,911,895 | B2 | 6/2005 | Mayr et al. |
| 8,400,240 | B2 | 3/2013 | Pfeiffer et al. |
| 2007/0095554 | A1 | 5/2007 | Noda |
| 2007/0219409 | A1 | 9/2007 | Shimizu et al. |
| 2013/0021123 | A1 | 1/2013 | Merrifield et al. |

* cited by examiner

MAGNETIC CONTROL DEVICES FOR ENCLOSURES

RELATED APPLICATION

This application is a divisional application of and claims the benefit of U.S. patent application Ser. No. 14/026,583, titled "Magnetic Control Devices For Enclosures" and filed on Sep. 13, 2013, in the name of Lewis T. Henderson, the entire disclosure of which are hereby fully incorporated herein by reference.

TECHNICAL FIELD

Embodiments described herein relate generally to magnetic control devices, and more particularly to systems, methods, and devices for magnetic control devices for enclosures.

BACKGROUND

When certain control devices (e.g., pushbuttons, switches) are integrated with a receptacle housing and enclosure system (simply called an "enclosure" herein), there is at least one aperture that is made in the enclosure to accommodate the control device. When the enclosure is located in certain environments, then the enclosure must comply with one or more of a number of standards and/or requirements. Examples of such environments can include, but are not limited to, military applications, onboard ships, assembly plants, power plants, oil refineries, and petrochemical plants. At times, the equipment located inside such enclosure is used to control motors and other industrial equipment.

In order for an enclosure to meet certain standards and requirements, the gap between the enclosure and the control device must be sealed within certain tolerances. If the gap is not properly maintained, then a point of environmental ingress and/or loss of integrity of the enclosure can result.

SUMMARY

In general, in one aspect, the disclosure relates to control device for an enclosure. The control device can include a first portion positioned proximate to a back side of an enclosure surface of the enclosure. The first portion of the control device can include a plunger having a proximal end and a distal end, where the plunger has a first position toward the enclosure surface and a second position away from the enclosure surface, and where the proximal end is adjacent to the enclosure surface. The first portion of the control device can also include a first magnet having a first polarity and disposed at the proximal end of the plunger. The first portion of the control device can further include at least one contact in communication with the distal end of the plunger, where the at least one contact has a first state and a second state. The control device can also include a second portion positioned proximate to a front side of the enclosure surface. The second portion of the control device can include a second magnet having a second polarity, where the second magnet has an engaged position and a disengaged position. The second magnet, when in the engaged position, generates a magnetic force with the first magnet, where the magnetic force moves the plunger to force the contact into the first state. The second magnet, when in the disengaged position, removes the magnetic force, where removal of the magnetic force moves the plunger to force the contact into the second state.

In another aspect, the disclosure can generally relate to an enclosure. The enclosure can include an enclosure surface having a front side and a back side. The enclosure can also include a control device disposed proximate to the enclosure surface. The control device of the enclosure can have a first portion positioned proximate to the back side of the enclosure surface. The first portion of the control device of the enclosure can include a plunger having a proximal end and a distal end, where the plunger has a first position toward the enclosure surface and a second position away from the enclosure surface, and where the proximal end is adjacent to the enclosure surface. The first portion of the control device of the enclosure can also include a first magnet having a first polarity and disposed at the proximal end of the plunger. The first portion of the control device of the enclosure can further include at least one contact in communication with the distal end of the plunger, where the at least one contact has a first state and a second state. The control device of the enclosure can also have a second portion positioned proximate to a front side of the enclosure surface. The second portion of the control device of the enclosure can include a second magnet having a second polarity, where the second magnet has an engaged position and a disengaged position. The second magnet, when in the engaged position, moves the plunger to force the contact into the first state. The second magnet, when in the disengaged position, moves the plunger to force the contact into the second state.

In yet another aspect, the disclosure can generally relate to a method for changing a state of an electrical device disposed within an enclosure. The method can include moving a first magnet located outside the enclosure from a first position to a second position, where the first magnet has a first polarity in the second position. The method can also include moving, using a magnetic field generated by the first polarity of the first magnet in the second position, a second magnet having a second polarity from a third position to a fourth position, where the second magnet is located inside the enclosure proximate to the enclosure surface. The method can further include changing, based on moving the second magnet to the fourth position, the state of the electrical device from a first state to a second state.

These and other aspects, objects, features, and embodiments will be apparent from the following description and the appended claims.

BRIEF DESCRIPTION OF THE DRAWINGS

The drawings illustrate only example embodiments of magnetic control devices for enclosures and are therefore not to be considered limiting of its scope, as magnetic control devices for enclosures may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
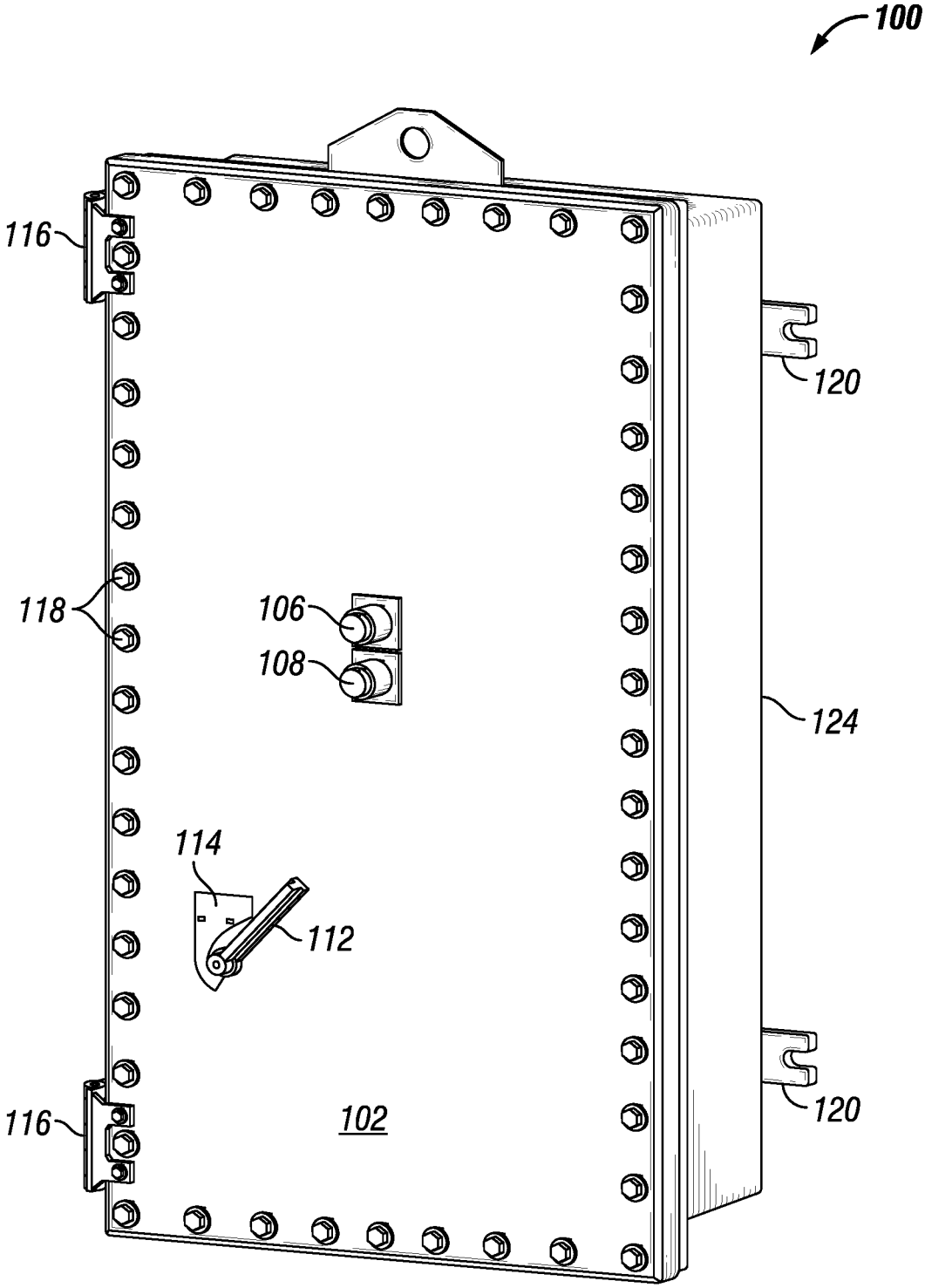
FIGS. 1 and 2 show an explosion-proof enclosure in which one or more example embodiments of magnetic control devices may be implemented.

The example embodiments discussed herein are directed to systems, apparatuses, and methods of magnetic control for a device in an explosion-proof enclosure. While the example embodiments discussed herein are with reference to explosion-proof enclosures, other types of non-explosion-proof enclosures (e.g., junction boxes, control panels, lighting panels, motor control centers, switchgear cabinets, relay cabinets) or any other type of enclosure (e.g., hazardous enclosure) may be used in conjunction with example embodiments of fastening devices. As used herein, an explosion-proof enclosure can be an enclosure that is suitable for potentially explosive environments.

As used herein, the cover and the body of an enclosure can be referred to as enclosure portions (e.g., top enclosure portion, bottom enclosure portion). Further, while example magnetic control devices are shown in the accompanying figures as being mechanically coupled to, or located proximate to, the cover of an enclosure, example fastening devices can, additionally or alternatively, be mechanically coupled to, or located proximate to, any other surface of the enclosure.

In one or more example embodiments, an explosion-proof enclosure (also sometimes called a flame-proof enclosure or a hazardous location enclosure) is an enclosure that is configured to contain an explosion that originates inside the enclosure. Further, the explosion-proof enclosure is configured to allow gases from inside the enclosure to escape across joints of the enclosure and cool as the gases exit the explosion-proof enclosure. The joints are also known as flame paths and exist where two surfaces meet and provide an uninterrupted path, from inside the explosion-proof enclosure toward the outside of the explosion-proof enclosure, along which one or more gases may travel. A joint may be a mating of any two or more surfaces. Each surface may be any type of surface, including but not limited to a flat surface, a threaded surface, a rabbet surface, and a serrated surface.

In one or more example embodiments, an explosion-proof enclosure is subject to meeting certain standards and/or requirements. For example, NEMA sets standards with which an enclosure must comply in order to qualify as an explosion-proof enclosure. Specifically, NEMA Type 7, Type 8, Type 9, and Type 10 enclosures set standards with which an explosion-proof enclosure within a hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class I, Division 1) and Underwriters' Laboratories, Inc. (UL) (e.g., UL 1203). For example, a Class I hazardous area under the National Electric Code is an area in which flammable gases or vapors may be present in the air in sufficient quantities to be explosive.

As a specific example, NEMA standards for an explosion-proof enclosure of a certain size (e.g., 100 $cm^3$) or range of sizes may require that in a Group B, Division 1 area, any flame path of an explosion-proof enclosure must be at least 1 inch long (continuous and without interruption), and the gap between the surfaces cannot exceed 0.0015 inches. Standards created and maintained by NEMA may be found at www.nema.org/stds and are hereby incorporated by reference.

A user as described herein may be any person that is involved with installation and/or maintenance of enclosures and/or devices within enclosures. Examples of a user may include, but are not limited to, a company representative, an electrician, an engineer, a mechanic, an operator, a consultant, a contractor, and a manufacturer's representative.

Magnets described herein are a material or object that creates a magnetic field. The magnetic field can either repel or attract another magnet, depending on how the polarity of the two magnets are oriented with respect to each other. The magnet can be a permanent magnet, an electromagnet, a rare-earth magnet, a nano-structured magnet, a single-molecule magnet, and/or any other type of magnet that can be used with the example control devices described herein. The strength of the magnetic field can be dictated by one or more of a number of factors, including but not limited to the size of the magnet, the temperature at which the magnet is exposed, and the material of the magnet. The strength of the magnetic field of each magnet can vary and can be set based on one or more of a number of factors, including but not limited to the distance between magnets, interference of the magnetic field by the enclosure surface, and forces (e.g., gravity, friction, resilient devices) that must be overcome.

Example magnetic control devices described herein can be used to change the state of an electrical device. Examples of an electrical device can include, but are not limited to, a VFD (defined below), a motor, a relay, a breaker, a switch, and a sensing device. The electrical device can be positioned inside of or outside of the enclosure. In any case, the electrical device is electrically coupled to a contact of the example control devices. The state of an electrical device can be one or more of a number of operating states, including but not limited to "on", "off", "slower", "faster", "up", "down", "left", "right", "open", and "close".

Example embodiments of magnetic control devices will be described more fully hereinafter with reference to the accompanying drawings, in which example embodiments of magnetic control devices are shown. Magnetic control devices may, however, be embodied in many different forms and should not be construed as limited to the example embodiments set forth herein. Rather, these example embodiments are provided so that this disclosure will be thorough and complete, and will fully convey the scope of magnetic control devices to those of ordinary skill in the art. Like, but not necessarily the same, elements (also sometimes called components) in the various figures are denoted by like reference numerals for consistency. Terms such as "first," "second," "distal," "proximal," "front," and "back" are used merely to distinguish one component (or part of a component) from another. Such terms are not meant to denote a preference or a particular orientation.

Figure 2:
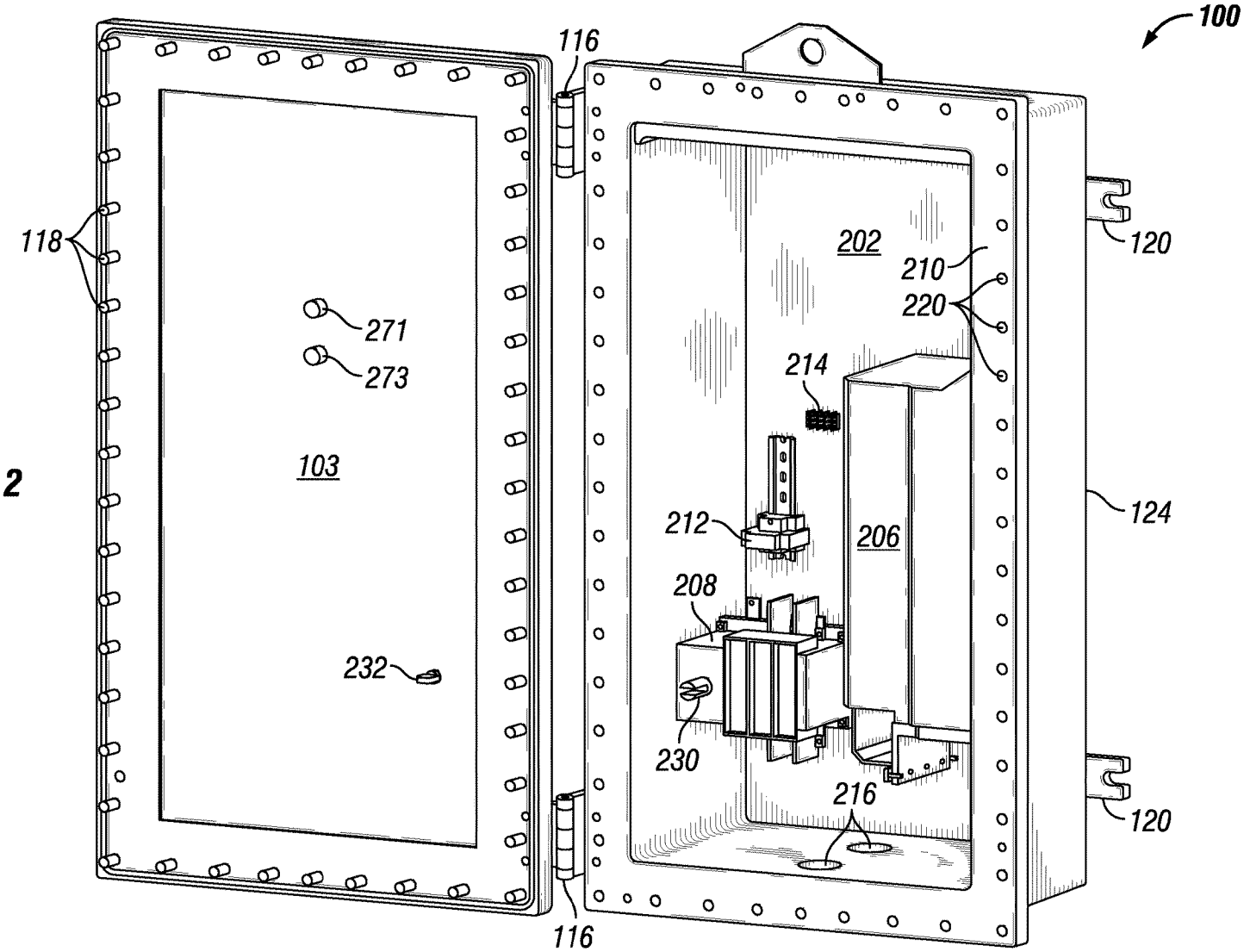

FIGS. 1 and 2 show various views of an example enclosure 100 in which one or more example embodiments of magnetic control devices may be implemented. Specifically, FIG. 1 shows a front perspective view of the enclosure 100 when the enclosure 100 is an a closed position. FIG. 2 shows a front perspective view of the enclosure 100 when the enclosure 100 is an open position.

Referring to FIGS. 1 and 2, the enclosure 100 is an explosion-proof enclosure 100. The enclosure cover 102 can be secured to the enclosure body 124 by a number of fastening devices 118 located at (and disposed through) a number of fastening device apertures (hidden from view) disposed around the perimeter of the enclosure cover 102 and a number of fastening device apertures 220 disposed around the perimeter of the enclosure body 124. The number of fastening device apertures 220 in the enclosure body 124 and in corresponding apertures in the enclosure cover 102 may vary, depending on one or more of a number of factors, including but not limited to the size of the fastening device apertures 220, a standard that the explosion-proof enclosure 100 meets, and the type of fastening device 118 used. The number of fastening device apertures 220 may be zero.

In one or more embodiments, a fastening device 118 may be one or more of a number of fastening devices, including but not limited to a bolt (which may be coupled with a nut), a screw (which may be coupled with a nut), and a clamp. In addition, one or more hinges 116 can be secured to one side of the enclosure cover 102 and a corresponding side of the enclosure body 124 so that, when all of the fastening devices 118 are removed, the enclosure cover 102 may swing outward (i.e., to an open position) from the enclosure body 124 using the one or more hinges 116. In one or more exemplary embodiments, there are no hinges, and the enclosure cover 102 is separated from the enclosure body 124 when all of the fastening devices 118 are removed.

The enclosure cover 102 and the enclosure body 124 may be made of any suitable material, including metal (e.g., alloy, stainless steel), plastic, some other material, or any combination thereof. The enclosure cover 102 and the enclosure body 124 may be made of the same material or different materials. In one or more embodiments, on the end of the enclosure body 124 opposite the enclosure cover 102, one or more mounting brackets 120 are affixed to the exterior of the enclosure body 124 to facilitate mounting the enclosure 100. Using the mounting brackets 120, the enclosure 100 may be mounted to one or more of a number of surfaces and/or elements, including but not limited to a wall, a control cabinet, a cement block, an I-beam, and a U-bracket.

The enclosure cover 102 may include one or more features that allow for user interaction while the enclosure 100 is sealed in the closed position. As shown in FIG. 1, one or more indicating lights (e.g., indicating light 1 106, indicting light 2 108) may be located on the enclosure cover 102. Each indicating light may be used to indicate a status of a feature or process associated with equipment inside the enclosure 100. For example, an indicating light may show a constant green light if a motor controlled by a VFD 206 inside the enclosure 100 is operating. As another example, an indicating light may flash red when a motor controlled by the VFD 206 inside the enclosure 100 has a problem (e.g., tripped circuit, VFD overheats, overcurrent situation). As another example, an indicating light may show a constant red light when an electromagnetic pulse caused by an explosion inside the enclosure 100 has resulted. An indicating light may be made of one or more materials (e.g., glass, plastic) using one or more different lighting sources (e.g., light-emitting diode (LED), incandescent bulb).

In one or more embodiments, the enclosure cover 102 may also include a switch handle 112 that allows a user to operate a switch 208 located inside the explosion-proof enclosure 100 while the explosion-proof enclosure 100 is closed. Those skilled in the art will appreciate that the switch handle 112 may be used for any type of switch. Each position (e.g., OFF, ON, HOLD, RESET) of the switch may be indicated by a switch position indicator 114 positioned adjacent to the switch handle 112 on the outer surface of the enclosure cover 102. The switch 208 associated with the switch handle 112 and the switch position indicator 114 may be used to electrically and/or mechanically isolate, and/or change the mode of operation of, one or more components inside or associated with the explosion-proof enclosure 100. For example, the switch handle 112 may point to "OFF" on the switch position indicator 114 when a disconnect switch 208 located inside the explosion-proof enclosure 100 is disengaged. In such a case, all equipment located inside the explosion-proof enclosure 100, as well as the equipment (e.g., a motor) controlled by the equipment located inside the explosion-proof enclosure 100, may be without power.

The explosion-proof enclosure 100 of FIG. 2 is in the open position because the enclosure cover 102 is not secured to the enclosure body 124. The hinges 116 attached to the left side of the enclosure body 124 are also attached to the left side of the enclosure cover, which is swung outward from the enclosure body 124. Because the explosion-proof enclosure 100 is in the open position, the components of the explosion-proof enclosure 100 are visible to a user.

In one or more embodiments, as shown in FIG. 2, the explosion-proof enclosure 100 includes a mounting plate 202 that is affixed to the back of the inside of the explosion-proof enclosure 100. The mounting plate 202 may be configured to receive one or more components such that the one or more components are affixed to the mounting plate 202. The mounting plate 202 may include one or more apertures configured to receive securing devices that may be used to affix a component to the mounting plate 202. The mounting plate 202 may be made of any suitable material, including but not limited to the material of the enclosure body 124. In one or more exemplary embodiments, some or all of the one or more components may be mounted directly to an inside wall of the explosion-proof enclosure 100 rather than to the mounting plate 202.

In one or more embodiments, a VFD 206 is affixed to the mounting plate 202 inside the explosion-proof enclosure 100. The VFD 206 may include any components used to drive a motor and/or other device using variable control signals for controlled starts, stops, and/or operations of the motor and/or other devices. Examples of components of a VFD include, but are not limited to, discrete relays, a programmable logic controller (PLC), a programmable logic relay (PLR), an uninterruptible power supply (UPS), and a distributed control system (DSC). In one or more exemplary embodiments, one or more components of the VFD may replace the VFD. For example, the VFD may be substituted by one or more PLCs, one or more PLRs, one or more UPSs, one or more DCSs, and/or other heat-generating components.

In one or more embodiments, a switch 208 is affixed to the mounting plate 202 inside the explosion-proof enclosure 100. The switch 208 may be configured to electrically and/or mechanically isolate, and/or change the mode of operation of, one or more components located inside the explosion-proof enclosure 100 and/or one or more components located outside the explosion-proof enclosure 100. The switch 208 may be any type of switch, including but not limited to a disconnect switch, a test switch, a reset switch, an indicator switch, and a relay switch. For example, the switch 208 may be a disconnect switch that is used to cut off power to all components in the explosion-proof enclosure 100 and all devices located outside the explosion-proof enclosure 100 that are controlled by the components inside the explosion-proof enclosure 100. As another example, the switch 208 may be a bypass switch that is used to deactivate a protection scheme (e.g., a relay) or some other particular component or group of components located inside the explosion-proof enclosure 100.

The switch 208 may further be configured to receive, through mechanical and/or electrical means, a directive to change states (e.g., open, closed, hold) from a component located on the enclosure cover. For example, if the enclosure cover includes a switch handle, as shown in FIG. 1, then a switch handle shaft 232 may extend from the switch handle through the enclosure cover to a switch coupling 230 of the switch 208. In such a case, the switch handle shaft 232 and/or other portions of the switch handle assembly create a flame path with the wall of the aperture in the enclosure cover 102 through which the switch handle shaft 232 extends. When the explosion-proof enclosure 100 is in the closed position, the switch handle shaft 232 couples with the switch coupling 230, and switch 208 may be operated by operating the switch handle located outside the explosion-proof enclosure, as shown in FIG. 1.

In one or more embodiments, one or more relays (e.g., relay 212) are affixed to the mounting plate 202 inside the explosion-proof enclosure 100. A relay 212 is a device that may be configured to control one or more operations of one or more components located in, or associated with, the explosion-proof enclosure 100. Specifically, a relay 212 may, through one or more relay contacts, allow electrical current to flow and/or stop electrical current from flowing to one or more components in the enclosure 100 based on whether a coil of the relay 212 is energized or not. For example, if the coil of the relay 212 is energized, then a contact on the relay may be closed to allow current to flow to energize a motor.

The relay 212 may be activated based on a timer, a current, a voltage, some other suitable activation method, or any combination thereof. The relay 212 may also be configured to emit a signal when a condition has occurred. For example, the relay 212 may flash a red light (e.g., indicating light 108) to indicate that the VFD 206 is in an alarm state. In such a case, wiring (not shown) can be run between a back side of an indicating light (e.g., back side 271 of indicating light 106, back side 273 of indicating light 108) and the relay 212. In such a case, the indicting light (e.g., indicating light 106, indicating light 108) creates a flame path with the wall of the aperture in the enclosure cover 102 through which the indicating light extends.

In one or more embodiments, wiring terminals 214 are affixed to the mounting plate 202 inside the explosion-proof enclosure 100. Wiring terminals 214 are a series of terminals where one terminal is electrically connected to at least one other terminal in the series of terminals while remaining electrically isolated from the remaining terminals in the series of terminals. In other words, two or more terminals among the series of terminals act as a junction point where multiple wires may be electrically connected through the joined terminals.

In one or more embodiments, one or more entry holes 216 may extend through one or more sides (e.g., bottom) of the enclosure body 124. Each entry hole 216 may be configured to allow cables and/or wiring for power, control, and/or communications to pass through from outside the explosion-proof enclosure 100 to one or more components inside the explosion-proof enclosure 100. An entry hole 216 may be joined with a conduit and coupling from outside the explosion-proof enclosure 100 to protect the cables and/or wiring received by the entry hole 216 and to help maintain the integrity of the explosion-proof enclosure 100 through the entry hole 216.

In certain example embodiments, a porous media assembly is mechanically coupled to one or more entry holes 216 that traverse a wall in the enclosure cover 102 and/or the enclosure body 124. In any case, the conduit, porous media assembly, or any other device that traverses an entry hole 216 creates a flame path between the conduit, porous media assembly, or any other device and the wall of the entry hole 216.

Figure 3A:
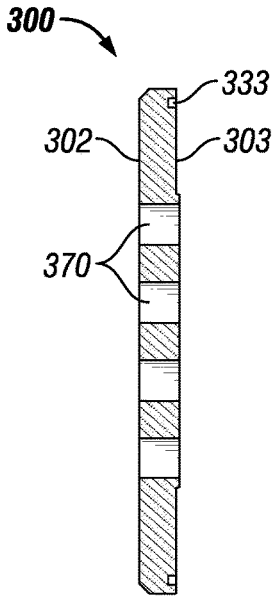
FIGS. 3A and 3B show cross-sectional side and front views, respectively, of an enclosure cover used with control devices currently known in the art.
Figure 3B:
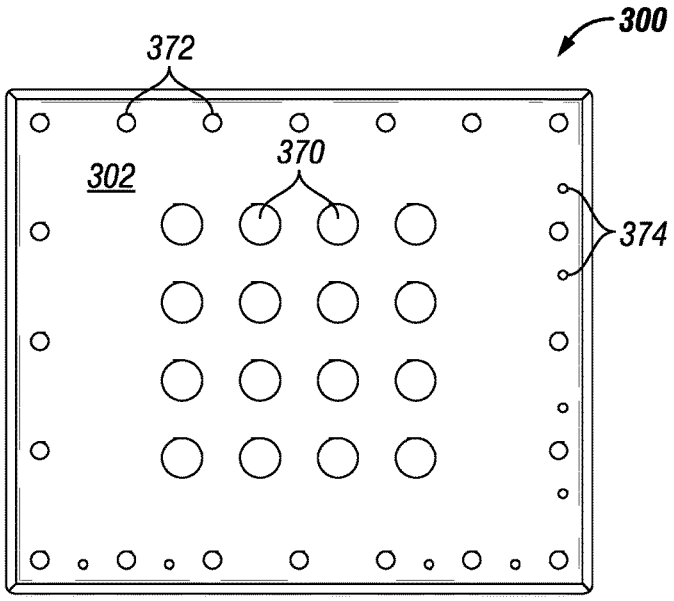

FIGS. 3A and 3B show cross-sectional side and front views, respectively, of an enclosure cover 300 used with control devices currently known in the art. Specifically, FIG. 3A shows a cross-sectional side view of the enclosure cover 300, and FIG. 3B shows a front view of the enclosure cover 300. In this case, there are a number of apertures that traverse the enclosure cover 300. For example, along the outer perimeter of the enclosure cover 300 are disposed a number of (in this case, 20) larger fastening device apertures 372. The fastening device apertures 372 are spaced substantially equidistant from each other along the outer perimeter of the enclosure cover.

As another example, along other portions of the outer perimeter of the enclosure cover 300 are disposed a number of (in this case, 8) smaller fastening device apertures 374 that traverse the enclosure cover 300. As yet another example, disposed in a middle portion of the enclosure cover 300 are a number of (in this case, 16) large control device apertures 370. These control device apertures 370 can be used for one or more switches, one or more pushbuttons, one or more indicating lights, and/or any of a number of other control devices that allow a user to communicate, from outside the enclosure, with one or more devices located inside the enclosure.

Each control device aperture 370 shown in the enclosure cover 300 creates a flame path with the control device that traverses therethrough. Similarly, each fastening device aperture 372 and fastening device aperture 374 creates a flame path with the fastening device (e.g., bolt, screw) that traverses therethrough. In some cases, along the outer perimeter of the back surface 303 of the enclosure cover 300 is a channel 333 for receiving a sealing member (e.g., a gasket, an o-ring). The channel 333 is shallow and does not traverse the enclosure cover 300 to the front surface 302. As a result, the channel 333 does not form a flame path.

As a result of the vast distribution of flame paths along the enclosure cover 300, the thickness of the enclosure cover 300 is maximized and is substantially uniform along the enclosure cover 300. In other words, the thickness between the front (outside) surface 302 and the back (inside) surface 303 of the enclosure cover 300 is substantially uniform along the length and width of the enclosure cover 300 This uniform thickness results in higher costs in manufacturing the enclosure cover 300 because of the larger amount of material required.

Figure 4A:
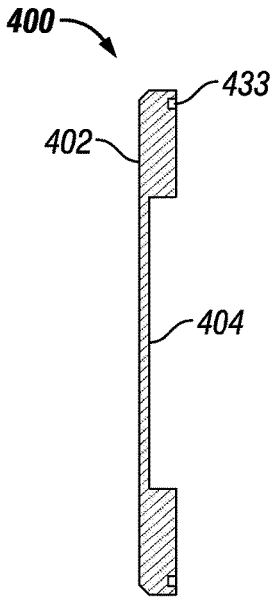
FIGS. 4A and 4B show cross-sectional side and front views, respectively, of an enclosure cover using example control devices in accordance with certain example embodiments.
Figure 4B:
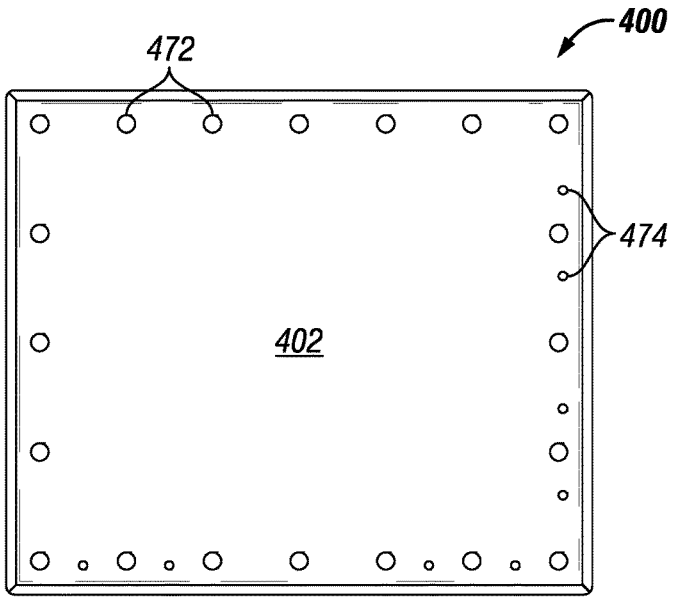

By contrast, using example magnetic control devices described herein, many of the apertures (particularly, the control device apertures) can be eliminated. FIGS. 4A and 4B show cross-sectional side and front views, respectively, of an enclosure cover 400 used with example magnetic control devices. Specifically, FIG. 4A shows a cross-sectional side view of the enclosure cover 400, and FIG. 4B shows a front view of the enclosure cover 400.

As with the enclosure cover 300 of FIGS. 3A and 3B, the enclosure cover 400 of FIGS. 4A and 4B can include a number of apertures that traverse the enclosure cover 400. For example, along the outer perimeter of the enclosure cover 400 are disposed a number of (in this case, 20) larger fastening device apertures 472. The fastening device apertures 472 are spaced substantially equidistant from each other along the outer perimeter of the enclosure cover. As another example, along other portions of the outer perimeter of the enclosure cover 400 are disposed a number of (in this case, 8) smaller fastening device apertures 474 that traverse the enclosure cover 400. Fastening devices that traverse the fastening device apertures 472 and the fastening device apertures 474 create a flame path with the walls of those apertures.

Also, as shown for the enclosure cover 300 of FIGS. 3A and 3B, disposed along the outer perimeter of a back surface 403 of the enclosure cover 400 is a channel 433 for receiving a sealing member (e.g., a gasket, an o-ring). The channel 433 is shallow and does not traverse the enclosure cover 400 to the front surface 402. As a result, the channel 433 does not form a flame path.

Unlike the enclosure cover 300 of FIGS. 3A and 3B, the enclosure cover 400 of FIGS. 4A and 4B does not have any apertures for control devices disposed in the enclosure cover 400. In other words, because example magnetic control devices are used with the enclosure cover 400, no apertures are made through the middle portion of the enclosure cover 400. As a result, there are no flame paths through the middle portion of the enclosure cover 400.

In addition, because there are no flame paths through the middle portion of the enclosure cover 400, less material is needed in the middle portion. Thus, as shown in FIG. 4A, the thickness of the enclosure cover 400 between the front surface 402 and the back surface 404 in the middle portion of the enclosure cover 400 is significantly less than the thickness of the enclosure cover 400 between the front surface 402 and the back surface 403 toward the outer perimeter of the enclosure cover 400. As explained above, to control the flame path through the apertures 472 and the apertures 474, the thickness between the front surface 402 and the back surface 403 toward the outer perimeter of the enclosure cover 400 must be sufficiently large. As a result, less material is needed to make the enclosure cover 400 compared to the enclosure cover 300 of FIGS. 3A and 3B. Further, the reduced thickness between the front surface 402 and the back surface 404 in the middle portion of the enclosure cover 400 can allow the magnetic forces of the magnetic control devices to communicate through the enclosure cover 400.

Figure 5A:
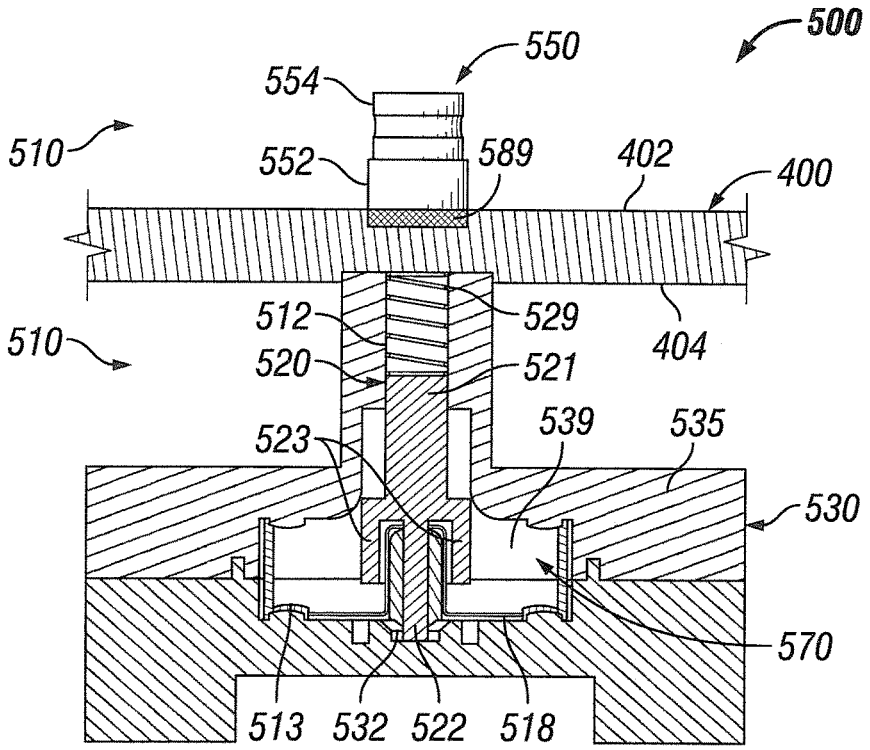
FIGS. 5A-5C show cross-sectional side views of an enclosure that includes an example control device in accordance with certain example embodiments.
Figure 5B:
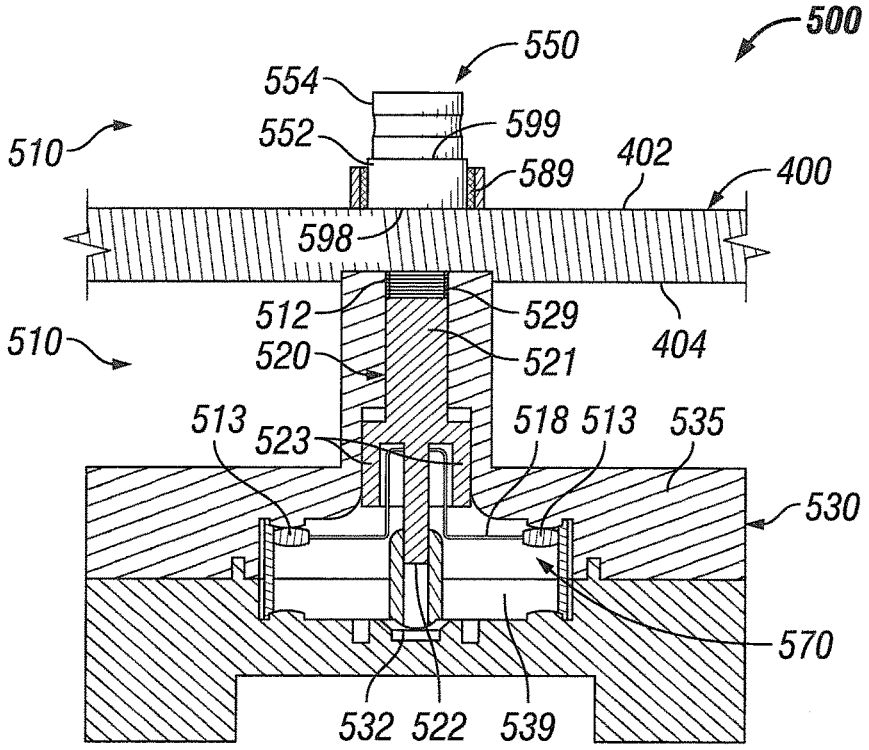
Figure 5C:
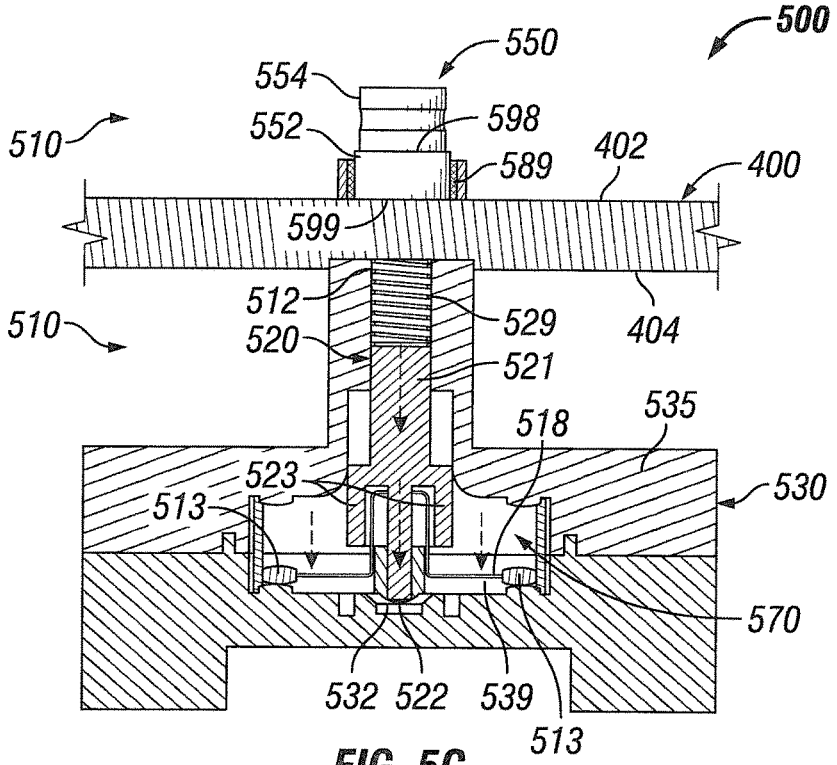

FIGS. 5A-5C show cross-sectional side views of an enclosure 500 that includes an example control device 510 in accordance with certain example embodiments. Specifically, FIG. 5A shows a cross-sectional side view of the enclosure 500 with the control device 510 in the disengaged position. FIG. 5B shows a cross-sectional side view of the enclosure 500 with the control device 510 in the engaged position. FIG. 5C shows a cross-sectional side view of the enclosure 500 of FIG. 5B with the control device 510 in the disengaged position. In one or more embodiments, one or more of the components shown in FIGS. 5A-5C may be omitted, added, repeated, and/or substituted. Accordingly, embodiments of an enclosure with a magnetic control device should not be considered limited to the specific arrangements of components shown in FIGS. 5A-5C.

Referring to FIGS. 1-5C, the enclosure 500 has an enclosure cover 400 that has a thickness measured from the front (outer) surface 402 to the back (inner) surface 404. Generally, the enclosure cover 400 can be referred to as an enclosure surface 400, which can be any surface of an enclosure cover and/or an enclosure body. In such a case, each enclosure surface 400 can have a front side 402 and a back side 404. The front side 402 of the enclosure surface 400 can be positioned outside of the enclosure, while the back side 404 of the enclosure surface 400 can be positioned inside of the enclosure.

In certain example embodiments, the control device 510 includes a first portion 530 and a second portion 550. The first portion 530 of the control device 510 can include a plunger 520, a magnet 512, and at least one contact 570. The second portion 550 can include a magnet 552. The first portion 530 of the control device 510 can be positioned proximate to (including affixed to or mechanically coupled to) the back side 404 of the enclosure surface 400 of the enclosure. The second portion 550 of the control device 510 can be positioned proximate to (including affixed to or mechanically coupled to) the front side 402 of the enclosure surface 400.

In certain example embodiments, one or more components (e.g., the plunger 520, the magnet 512) of the first portion 530 are positioned within a housing 535. The housing 535 can include a cavity 539 inside of which these one or more components of the first portion 530 can move within a range of motion. For example, the cavity 539 can allow for the plunger 520, the magnet 512, and the at least one contact 570 to move within a range of motion.

The housing 535 can be mechanically coupled to the back side 404 of the enclosure surface 400. In such a case, the back side 404 of the enclosure surface 400 can include one or more receiving features for receiving the housing 535. For example, as shown in FIGS. 5A-5C, the back side 404 of the enclosure surface 400 can include a recessed area into which the top end of the housing 535 can be disposed. The housing 535 can be mechanically coupled to the back side 404 of the enclosure surface 400 (including any receiving features) using one or more of a number fastening mechanisms, including but not limited to mating threads, epoxy, soldering, welding, snap fittings, compression fitting, slots, tabs, and fastening devices (e.g., screws, bolts). In any case, the receiving features of the back side 404 and/or any fastening mechanisms do not traverse the thickness of the enclosure surface 400 to the front side 402 of the enclosure surface 400. In other words, mechanically coupling the housing 535 to the enclosure surface 400 does not create a flame path.

In certain example embodiments, the plunger 520 of the first portion 530 has a proximal end (positioned adjacent to the back side 404 of the enclosure surface 400) and a distal end (positioned furthest away from the back side 404 of the enclosure surface 400). As discussed above, the plunger 520 can move within a range of motion provided by the cavity 539 of the housing 535. For example, in a first position, the plunger 520 can be positioned within the cavity 539 toward the enclosure surface 400, where the plunger 520 can be positioned within the cavity 539 away from the enclosure surface 400 in a second position.

As described herein, the distal end of the plunger 520 can be any portion (e.g., middle, far end) of the plunger 520 that is not the proximal end of the plunger 520. The distal end of the plunger 520 can include one or more of a number of features. For example, the distal end of the plunger 520 can include at least one feature that mechanically couples the plunger 520 to one or more contacts 570. In this case, the distal end of the plunger 520 includes a pair of forked sides 523 that extend beyond the outer perimeter of the main body 521 of the plunger 520. Within each forked side 523 is disposed a contact arm 518 (described below), which allows the contact arm 518 to move with the plunger 520 within the cavity 539 of the housing 535.

As another example, the plunger 520 can include at least one feature that prevents the plunger 520 from continuing movement within the cavity 539 of the housing 535. In this case, the distal end of the plunger 520 can include a central member 522 the extends below the forked sides 523 and the contact arms 518. In such a case, the central member 522 prevents the plunger 520 from moving further downward once the plunger 520 is in the second position within the cavity 539 of the housing 535. In other words, the central member 522 contacts a stop 532 within the cavity 539 when the plunger 520 is in the second position. Similarly, the forked sides 523 can be used to prevent the plunger 520 from moving further upward once the plunger 520 is in the first position within the cavity 539 of the housing 535.

In certain example embodiments, the magnet 512 of the first portion 530 of the control device 510 has a polarity. For example, the top end of the magnet 512 can have a polarity. In such a case, the bottom end of the magnet 512 can have another polarity that is opposite the polarity of the top end of the magnet 512. The magnet 512 can be disposed at the proximal end of the plunger 520. In such a case, the magnet 512 can be mechanically coupled to the proximal end of the plunger 520 using one or more of a number of fastening mechanisms, including but not limited to magnetic force, mating threads, epoxy, soldering, welding, snap fittings, compression fitting, slots, tabs, and fastening devices (e.g., screws, bolts).

In certain example embodiments, the magnet 512 and the plunger 520 are the same component, so that the plunger 520 is a magnet with at least one polarity at the distal end. Otherwise, the magnet 512 and the plunger 520 are separate components of the first portion 530 of the control device 510. In any case, the magnet 512 and the plunger 520 can move together between the first position and the second position of the plunger 520 within the cavity 539 of the housing 535. In such a case, the magnet 512 is positioned closest to the enclosure surface 400 when the plunger 520 is in the first position, and the magnet 512 is positioned furthest away from the enclosure surface 400 when the plunger 520 is in the second position.

Each of the one or more contacts 570 can include a contact arm 518 and a contact pad 513. The contact arms 518, described briefly above, can provide a structural (and in some cases electrical) link for the contact pads 513 so that the contact pads 513 move in conjunction with the plunger 520. Thus, each contact 570 is in communication with the distal end of the plunger 520. In other words, as the plunger 520 (and, consequently, the magnet 512) are in the first position, the contact pads are positioned toward the top of the cavity 539 of the housing 535. Similarly, as the plunger 520 (and, consequently, the magnet 512) are in the second position, the contact pads are positioned toward the bottom of the cavity 539 of the housing 535.

In certain example embodiments, each contact 570 has a first state and a second state. The first state of a contact 570 can coincide with the plunger 520 being in the first position, and the second state of a contact 570 can coincide with the plunger 520 being in the second position. The first state of a contact 570 can be an open position (in which the contact is open, preventing current from flowing therethrough) or a closed position (in which the contact is closed, allowing current from flowing therethrough). The contact arm 518 can be made of an electrically conductive material. In such a case, the contact arm 518 can provide electrical continuity within a contact 570 and/or between contacts 570.

The second state of a contact 570 can be the opposite of the first state of the contact 570. In other words, if the first state of a contact 570 closes the contact 570 (puts the contact 570 in a closed position), then the second state of the contact 570 opens the contact 570. Conversely, if the first state of a contact 570 opens the contact 570 (puts the contact 570 in an open position), then the second state of the contact 570 closes the contact 570. The change in the state of a contact 570 can be used to control the operation (e.g., change the state) of one or more electrical devices.

If there is more than one contact 570, the first state of one contact 570 can be the same as, or different than, the first state of another contact 570. Whether the first state of a contact 570 is open or closed can depend on one or more of a number of factors, including but not limited to the configuration of the cavity 539, the shape of the contact arm 518, and the position along the distal end of the plunger 520 where the contact arm 518 is attached. In certain example embodiments, a user can change the first state of a contact 570 from open to closed, or from closed to open.

Optionally, the first portion 530 of the control device 510 can include a resilient device 529 (e.g., a spring). The resilient device 529 can be used to put the plunger 520 (and, thus, the magnet 512) in a default position within the cavity 535 of the housing 530. The default position of the plunger 520 can be the first position or the second position, depending on where the resilient device 529 is placed relative to the plunger 520 within the cavity 535 of the housing 530. In such a case, the plunger 520 remains in the default position unless a force sufficient to overcome the force of the resilient device 529 is applied in a direction opposite the direction of the force applied by the resilient device 529.

For example, a magnetic force generated between the magnet 512 and the magnet 552 (e.g., when the polarities of magnet 512 and magnet 552 attract each other) can be applied in opposition to the force applied by the resilient device 529 and can have a magnitude greater than the force applied by the resilient device 529 to force the plunger 520 from the default position to the other position. When the magnetic force opposing the resilient device 529 is removed (e.g., when the polarities of magnet 512 and magnet 552 oppose each other), the plunger 520 returns to the default position from the other position. In certain example embodiments, regardless of whether there is a resilient device 529, the magnetic force must overcome one or more other forces, including but not limited to gravity and friction between the plunger 520 and the walls of the cavity 535.

For example, as shown in FIGS. 5A-5C, the resilient device 529 can be disposed on the proximal end of the plunger 520 and/or some other portion of the plunger 520, making the second position the default position for the plunger 520. In other words, the resilient device 529 applies a downward (away from the enclosure surface 400) force to the plunger 520. In addition, one or more features (e.g., lips, notches, recesses) can be disposed in the walls of the cavity 535 to allow the resilient device 529 to apply the downward force on the plunger 520. Alternatively, as shown in FIGS. 5A-5C, the resilient device 529 can use the back side 404 of the enclosure surface 400 to apply the downward force on the plunger 520.

To make the second position the default position for the plunger 520, the resilient device 529 can be disposed over (e.g., wound around) the magnet 512. The outer perimeter of the magnet 512 (or the proximal end of the plunger 520 if the magnet 512 is integrated as part of the plunger 520) can be less than the outer perimeter of the proximal end of the plunger 520 (or the distal end of the plunger 520) so that the resilient device 529 can be disposed over the magnet 512 (or the proximal end of the plunger 520) and sit atop a lip formed by the proximal end of the plunger 520 (or where the distal end of the plunger 520 meets the proximal end of the plunger 520). In such a case, the outer perimeter of the resilient device 529 can be substantially the same as the proximal end of the plunger 520 (or the distal end of the plunger 520).

To make the first position the default position for the plunger 520, the resilient device 529 can be disposed over some or all of the distal end of the plunger 520. In addition, one or more features (e.g., lips, notches, recesses) can be disposed in the walls of the cavity 535 to allow the resilient device 529 to apply an upward (toward the enclosure surface 400) force on the plunger 520. In any case, the force required to overcome the force of the resilient device 529 (e.g., compress the resilient device 529) and move the plunger 520 from the default position to the other position within the cavity 535 of the housing 530 is less than the magnetic force generated between the magnet 512 and the magnet 552.

The magnet 552 of the second portion 550 of the control device 510 can have a polarity. For example, the top end of the magnet 552 can have a polarity. In such a case, the bottom end of the magnet 552 can have another polarity that is opposite the polarity of the top end of the magnet 552. The magnet 552 can be free-standing, having no other features and being the only component of the second portion 550 of the control device 510. Alternatively, the magnet 552 can include one or more features. For example, as shown in FIGS. 5A and 5B, the magnet 552 can include a handling feature 554, mechanically coupled to one side of the magnet 552, that allows a user to lift and move the magnet 552 into, or away from, a certain position on the front side 402 of the enclosure surface 400.

In such a case, the handling feature 554 can be mechanically coupled to the magnet 552 using one or more of a number of coupling methods, including but not limited to mating threads, epoxy, soldering, welding, snap fittings, compression fitting, slots, tabs, and fastening devices (e.g., screws, bolts). In certain example embodiments, the mechanical coupling between the handling feature 554 and the magnet 552 is secure enough to be maintained when moving the magnet 552 in opposition to the magnetic force between the magnet 552 and the magnet 512.

An optional component of the second portion 550 of the control device 510 is a recessed area (shown in FIG. 5A) and/or a collar (shown in FIG. 5B) disposed on the front side 402 of the enclosure surface 400. Such component(s) can be called a receiving feature 589. The receiving feature 589 can be shaped and/or sized to receive the magnet 512. The receiving feature 589 can be used to properly position the magnet 552 relative to the position of the magnet 512 on the back side 404 of the enclosure surface 400. Any such components that may be part of the second portion 550 do not traverse the entire thickness of the enclosure surface 400, and so no flame path is created by the existence of such components of the second portion 550. Other components, features, and/or configurations of the second portion 550 can be used. An example of such other components, features, and configurations are described below with respect to FIG. 6.

When the polarity of the magnet 512 relative to the magnet 552 does not change, the magnet 552 can have an engaged position and a disengaged engaged position. When the polarity of the portion of the magnet 552 positioned adjacent to, or in contact with, the front side 402 of the enclosure surface 400 opposes the polarity of the portion of the magnet 512 positioned adjacent to, or in contact with, the back side 404 of the enclosure surface 400, a magnetic force is created between the magnet 512 and the magnet 552. This magnetic force creates an attraction between the magnet 512 and the magnet 552. In such a case, the magnet 552 is in the engaged position.

When the polarity of the portion of the magnet 552 positioned adjacent to, or in contact with, the front side 402 of the enclosure surface 400 is the same as the polarity of the portion of the magnet 512 positioned adjacent to, or in contact with, the back side 404 of the enclosure surface 400, a magnetic force is created between the magnet 512 and the magnet 552. This magnetic force repels the magnet 512 from the magnet 552. In such a case, the magnet 552 is in the disengaged position.

Depending on, at least, the orientation of each contact 570 relative to the plunger 520 and the position of the plunger 520 when the magnet 552 is in the engaged position, when the magnet 552 is in the engaged position, the contact 570 can be in the open position or in the closed position. Conversely, when the magnet 552 is in the disengaged position, the contact 570 is put into the opposite position (i.e., the closed position or the open position) as the position of the contact 570 when the magnet 552 is in the engaged position Similarly, when the magnet 552 is put in the engaged position, the plunger 520 can be put in the first position or the second position, where such position is not the default position. Conversely, when the magnet 552 is put in the disengaged position, the plunger 520 can be put in the second position or the first position, where such position is the default position.

To move the magnet 552 between the engaged position and the disengaged position, the magnet 552 can be subjected to one or more movements, depending on the components, features, and configurations of the second portion 550 of the control device 510. For example, as shown in FIGS. 5A and 5B, the magnet 552 can be physically removed from actual or near contact with the front side 402 of the enclosure surface 400. In such a case, the magnet 552 only needs to be removed at enough of a distance so that the magnetic force between magnet 552 and magnet 512 is weak enough to be overcome by the force of the resilient device 529 (and/or, in some cases, other forces such as gravity and friction).

As another example, as shown in FIGS. 5B and 5C, the magnet 552, having one polarity on one side 599 and an opposite polarity on the other side 598, can be flipped over and held in place against (or in proximity to) the front side 402 of the enclosure surface 400. In such cases, where one or more receiving features 589 (e.g., recessed area shown in FIG. 5A, collar shown in FIGS. 5B and 5C) are disposed on the front side 402 of the enclosure surface 400, a tool (e.g., a release paddle, a pry bar) can be used to help release the magnet 552 and/or overcome the attractive magnetic force between the magnet 512 and the magnet 552 to allow the magnet 552 to be flipped from the engaged position to the disengaged position. As a specific example, in FIG. 5B, the magnet 552 is oriented so that side 598 is disposed closest to magnet 512. In this case, the polarity of the side 598 of the magnet 552 is opposite the polarity of magnet 512, and so magnet 512 is attracted toward magnet 552. This attractive force between magnet 512 and magnet 552 overcomes the downward force applied by the resilient device 529 and keeps the plunger 520 and the contacts 570 held in an upward position within the cavity 539. If the magnet 552 is flipped, as shown in FIG. 5C, so that side 599 is disposed closest to magnet 512, and if the polarity of the side 599 of the magnet 552 is the same as the polarity of magnet 512, magnet 512 is repelled away from magnet 552. This repelling force between magnet 512 and magnet 552 can be aided by the downward force applied by the resilient device 529 and keeps the plunger 520 and the contacts 570 held in a downward position within the cavity 539.

Figure 6:
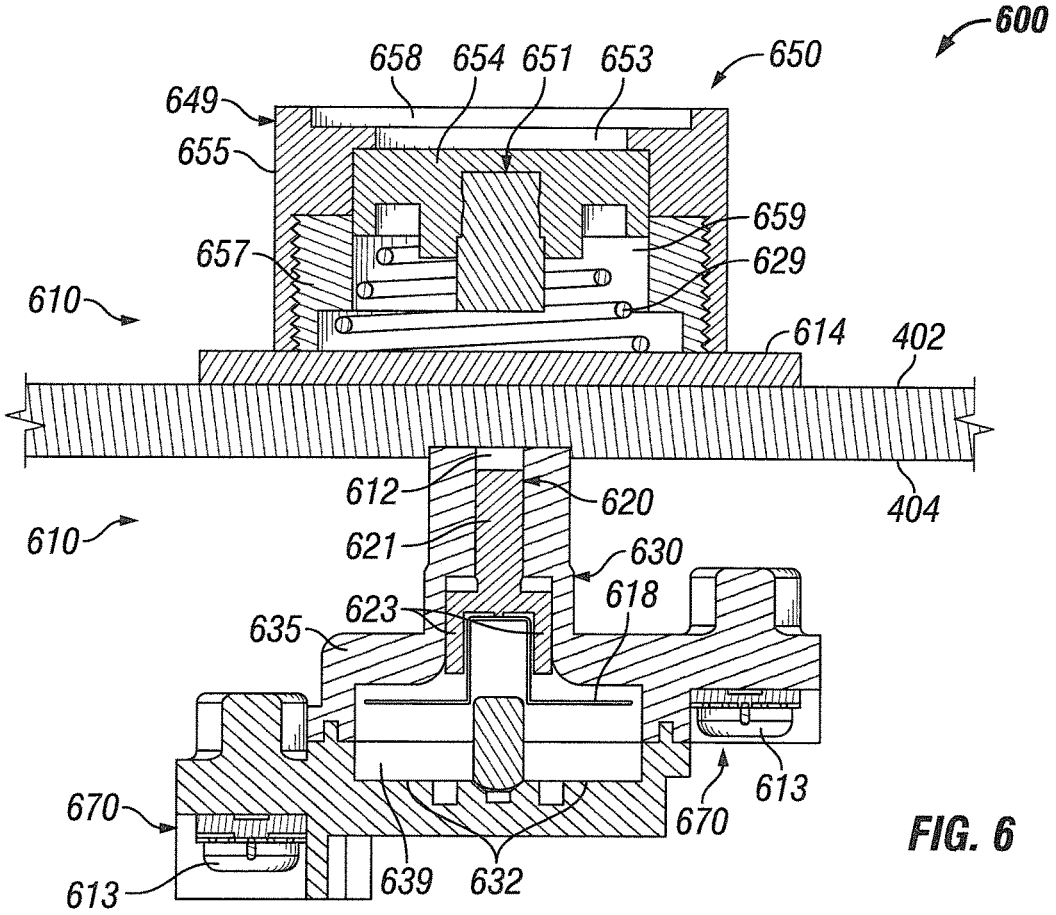
FIG. 6 shows a cross-sectional side view of another enclosure that includes another example control device in accordance with certain example embodiments.

FIG. 6 shows a cross-sectional side view of another enclosure 600 that includes another example control device 610 in accordance with certain example embodiments. In one or more embodiments, one or more of the components shown in FIG. 6 may be omitted, added, repeated, and/or substituted. Accordingly, embodiments of an enclosure with a magnetic control device should not be considered limited to the specific arrangements of components shown in FIG. 6.

The enclosure surface 400 and the control device 610 of FIG. 6 are substantially the same as the enclosure surface 400 and the control device 510 of FIGS. 5A and 5B, except as described below. The description for any component (e.g., contact pad 613) of FIG. 6 not provided below can be considered substantially the same as the corresponding component (e.g., contact pad 513) described above with respect to FIGS. 5A and 5B. The numbering scheme for the components of FIG. 6 parallel the numbering scheme for the components of FIGS. 5A and 5B in that each component is a three digit number, where similar components between the control device 610 and the control device 510 have the identical last two digits.

The resilient device 629 is now part of the second portion 650 of the control device 610 rather than the first portion 630, as in FIGS. 5A and 5B. In this case, second portion 650 of the control device 610 includes a pushbutton assembly 649, and the resilient device 629 is part of the pushbutton assembly 649. Specifically, the resilient device 629 is positioned within a pushbutton housing 655 and is wrapped around a shaft 651 of the pushbutton assembly 649. The resilient device 629, in this case, is positioned between a base member 614 and a bridge 654. Alternatively, the resilient device 629 can be positioned at any other point in the pushbutton assembly 649.

In certain example embodiments, the purpose of the resilient device 629 is to maintain the pushbutton assembly 649 in an unpushed state (a default state or default position for the second portion 650) absent an opposing force that is strong enough to overcome the upward force imposed by the resilient device 629. If a sufficient downward force is applied to the pushbutton 658, where such downward force overcomes, at least, the upward force of the resilient device 629, then the pushbutton assembly is in a pushed state.

The pushbutton assembly 649 can be mechanically coupled to the second magnet 652. For example, as shown in FIG. 6, the bridge 654 of the pushbutton assembly 649 can contact the top end of the shaft 651. The bottom end of the shaft 651 can be coupled to, or include, the magnet 652. Thus, when the pushbutton assembly 649 is moved from the unpushed state to the pushed state, the magnet 652 is moved downward and approaches the front side 402 of the enclosure surface 400.

In this case, the polarity of the magnet 652 remains fixed (i.e., the magnet 652 cannot be flipped to expose the opposite polarity to the magnet 612). Thus, the magnetic force between the magnet 612 and the magnet 652 is always attractive or always repellent. For the configuration shown in FIG. 6, if the polarities of the magnet 612 and the magnet 652 are opposing (attract each other), when the pushbutton assembly 649 is in the unpushed state, then the magnetic force between the magnet 652 and the magnet 612 is too weak to draw the plunger 620 upward. In such a case, the plunger 620 is in the default position, which is the second position.

When the pushbutton assembly 649 is in the pressed state, then the magnetic force between the magnet 652 and the magnet 612 is strong enough to draw the plunger 620 upward into the first position. Likewise, when the pushbutton assembly 649 is released to the unpushed state, then the force of gravity returns the plunger 620 to the default position. In certain example embodiments, an additional resilient device can be included in the first portion 630 of the control device 610, as described above with respect to the control device 510 of FIGS. 5A and 5B, to help return the plunger 620 to the default position.

Alternatively, the polarities of the magnet 612 and the magnet 652 can be the same (repel other). In such a case, another resilient device can be used with the first portion 630 of the control device 610, as described above with respect to the control device 510 of FIGS. 5A and 5B. Thus, the default position of the plunger 620 can be the first position. When the pushbutton assembly 649 is in the unpushed state, then the magnetic force between the magnet 652 and the magnet 612 is too weak to push the plunger 620 downward. When the pushbutton assembly 649 is in the pressed state, then the magnetic force between the magnet 652 and the magnet 612 is strong enough to push the plunger 620 downward into the second position. When the pushbutton assembly 649 is in the unpushed state, then the plunger 620 returns to the default (in this case, the first) position.

The pushbutton assembly 649 can include one or more of a number of components. For example, in this case, the pushbutton assembly 649 can include a transition component positioned between the pushbutton 658 and the bridge 654. All of these elements can be disposed within a cavity of the pushbutton housing 655, which can be mechanically coupled to a coupling member 657. The pushbutton housing 655 can be mechanically coupled to the coupling member 657 using one or more of a number of coupling methods, including but not limited to mating threads (as shown in FIG. 6), compression fittings, welding, and fastening devices. The coupling member 657 can be mechanically coupled to, or part of, the base member 614. The base member 614 can be mechanically coupled to, or part of, the front side 402 of the enclosure surface 400. In any case, none of the second portion 650 of the control device 610 traverses the thickness of the enclosure surface 400, and so the second portion 650 does not create a flame path.

The contacts 670 of the first portion 630 of the control device 610 are configured so that the contact 670 shown on the right side of FIG. 6 is in a closed position when the plunger 620 is in the first position and in an open position when the plunger 620 is in the second position. Conversely, the contact 670 shown on the left side of FIG. 6 is in an open position when the plunger 620 is in the first position and in a closed position when the plunger 620 is in the second position. In addition, the distal end of the plunger 620 of FIG. 6 does not include a central member. Instead, the contact arms 618 abut against the stop 632 to prevent the plunger 620 from traveling further downward within the cavity 635.

Figure 7:
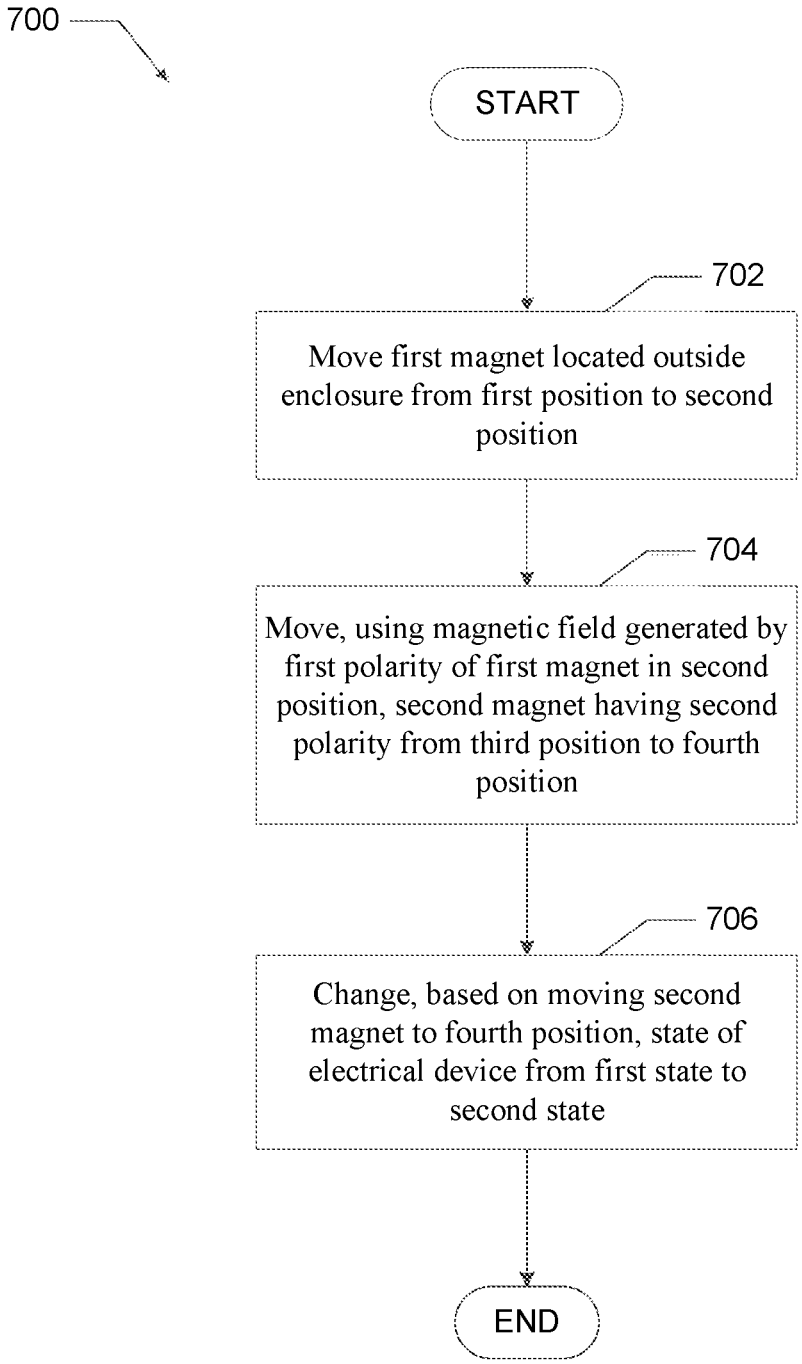
FIG. 7 shows a flow chart of a method for changing a state of an electrical device disposed within an enclosure in accordance with certain example embodiments.

FIG. 7 is a flow chart presenting a method 700 for changing the state of an electrical device disposed within an enclosure using an example magnetic control device in accordance with certain example embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps not shown in FIG. 7 may be included in performing this method. Accordingly, the specific arrangement of steps should not be construed as limiting the scope.

Referring now to FIGS. 1-7, the example method 700 begins at the START step and proceeds to step 702, where the magnet 552 located outside the enclosure surface 400 is moved from a first position to a second position. In certain example embodiments, the magnet 552 is part of the second portion 550 of the control device 510. The enclosure surface 400 can be part of an enclosure 500. The magnet 552 can be part of the second portion 550 of the control device 510. The magnet 552 can be moved directly or indirectly by a user. Moving the magnet 552 can require a minimal amount of force to overcome one or more of a number of opposing forces. Such opposing forces can include, but are not limited to, friction, a resilient device 529, and a magnetic force. Alternatively, moving the magnet 552 from the first position to the second position can be achieved when a user removes a force that is applied, directly or indirectly, to the magnet 552.

In certain example embodiments, the side of the magnet 552 facing the front side 402 of the enclosure surface 400 has a polarity and creates a magnetic field. The first position of the magnet 552 can be proximate to (or in contact with) the front side 402 of the enclosure surface 400, while the second position can be further away from the front side 402 of the enclosure surface 400. Alternatively, the first position of the magnet 552 can be removed from the front side 402 of the enclosure surface 400, while the second position can be proximate to (or in contact with) the front side 402 of the enclosure surface 400.

In step 704, the magnet 512 is moved from a third position to a fourth position. The magnet 512 can be moved using the magnetic field generated by the polarity of the magnet 552 while the magnet 552 is in the second position. In certain example embodiments, the magnet 512 is located inside the enclosure 500 proximate to the back side 404 of the enclosure surface 400. The magnet 512 can be part of a first portion 530 of the control device 510. The side of the magnet 512 facing the enclosure surface 400 can have a polarity that is the same as, or opposite of, the polarity of the magnet 552.

The third position of the magnet 512 (described as the first position with respect to FIGS. 5A and 5B above) can be proximate to (or in contact with) the back side 404 of the enclosure surface 400, while the fourth position (described as the second position with respect to FIGS. 5A and 5B above) can be further away from the back side 404 of the enclosure surface 400. Alternatively, the third position of the magnet 512 can be removed from the back side 404 of the enclosure surface 400, while the second position can be proximate to (or in contact with) the back side 404 of the enclosure surface 400. If the polarity of the magnet 552 is the same as the polarity of the magnet 512, then the fourth position is away from the enclosure surface 400. Alternatively, if the polarity of the magnet 552 is opposite of the polarity of the magnet 512, then the fourth position is proximate to (or in contact with) the back side 404 of the enclosure surface 400.

In step 706, the state of the electrical device can be changed from a first state to a second state. A state of the electrical device can be any of a number of operating states, including but not limited to "on", "off", "slower", and "faster". The state of the electrical device can be changed based on moving the magnet 512 to the fourth position. In doing so, a contact 570 of the first portion 530 of the control device 510, through the plunger 520, changes from an open state to a closed state or from a closed state to an open state. After step 706 is complete, the process can proceed to the END step.

Alternatively, once step 706 is complete, other steps can be performed. For example, magnet 552 can be returned to the first position. The magnet 552 can return to the first position when a user removes the force used to move the magnet 552 to the second position. Alternatively, the magnet 552 can return to the first position by applying a new force, directly or indirectly, by the user to the magnet 552.

When the magnet 552 is returned to the first position, the magnet 512 is moved back to the third position from the fourth position. The magnet 512 can be moved to the fourth position using the magnetic field created by the magnet 552. Specifically, the attraction or repulsion of the magnet 512 from the magnet 552 can be based on the opposite or same polarity, respectively, of the magnet 552 and the magnet 512. When the magnet 512 is moved back to the fourth position, changing, the electrical device is changed to a different state. In certain example embodiments, the electrical device is changed from the second state back to the first state. Alternatively, the electrical device can be changed from the second state to some other state.

In certain example embodiments, the magnetic control device described herein can be used to control one or more electrical devices located inside an enclosure without requiring an aperture that traverses a surface of the enclosure. In such a case, when the enclosure is used in potentially explosive environments, no flame path is created as a result of the magnetic control device. As a result, the enclosure can meet one or more standards and/or regulations with which such an enclosure must comply.

Using example magnetic control devices described herein saves on material costs by allowing for smaller thicknesses of an enclosure surface while allowing the enclosure to maintain its structural and mechanical integrity. Again, because there are no flame paths created by the magnetic control devices described herein, the use of thinner enclosure surfaces allows the enclosure to meet one or more standards and/or regulations with which such an enclosure must comply.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A control device for an enclosure, the control device comprising:

a first portion positioned proximate to a back side of an enclosure surface of the enclosure, wherein the first portion comprises:

a plunger comprising a proximal end and a distal end, wherein the plunger has a first position toward the enclosure surface and a second position away from the enclosure surface, and wherein the proximal end is adjacent to the enclosure surface;

a first magnet having a first polarity and disposed at the proximal end of the plunger; and at least one contact in communication with the distal end of the plunger, wherein the at least one contact has a first state and a second state; and a second portion positioned on a front side of the enclosure surface opposite the first portion on the back side of the enclosure, wherein the second portion comprises:

a receiving feature positioned on the front side of the enclosure surface; and a second magnet removably disposed within the receiving feature, wherein the second magnet has a first side and a second side opposite the first side, wherein the first side has the first polarity, wherein the second side has a second polarity that opposes the first polarity, wherein the second magnet is in an engaged position when the first side is positioned proximate to the front side of the enclosure surface, and wherein the second magnet is in a disengaged position when the second side is positioned proximate to the front side of the enclosure surface, wherein the second magnet, when in the engaged position, generates a first magnetic force with the first magnet, wherein the first magnetic force moves the plunger to force the contact into the first state, and wherein the second magnet, when in the disengaged position, generates a second magnetic force, wherein the second magnetic force moves the plunger to force the contact into the second state.

2. The control device of claim 1, wherein the second magnet, in the engaged position, pulls the plunger into the first position, and wherein the second magnet, in the disengaged position, repels the plunger to a default position.

3. The control device of claim 2, wherein the default position is the second position.

4. The control device of claim 3, wherein the second magnet, in the engaged position, pushes the plunger to the second position, and wherein the second magnet, in the disengaged position, releases the plunger to a default position.

5. The control device of claim 1, wherein the receiving feature comprises a recessed area in the front side of the enclosure surface.

6. The control device of claim 1, wherein the receiving feature comprises a collar disposed on the front side of the enclosure surface.

7. The control device of claim 1, wherein the second magnet is flipped between the first side and the second side relative to the receiving feature.

8. The control device of claim 1, wherein the first state of the at least one contact closes the at least one contact, and wherein the second state of the at least one contact opens the at least one contact.

9. The control device of claim 1, wherein the first portion further comprises:

a housing mechanically coupled to the back side of the enclosure surface, wherein the plunger, the first magnet, and the at least one contact are disposed within the housing.

10. The control device of claim 1, wherein the first portion further comprises:

a resilient device disposed on the proximal end of the plunger, wherein the resilient device maintains the plunger in the second position absent a greater force directing the plunger toward the first position.

11. The control device of claim 1, wherein the enclosure is an explosion-proof enclosure, wherein the explosion-proof enclosure has at least one joint that forms a flame path, wherein the at least one joint is located away from the first portion and the second portion of the control device.

12. The control device of claim 1, wherein the first portion further comprises at least one contact arm disposed at the distal end of the plunger, wherein the at least one contact in communication with the at least one contact arm.

13. The control device of claim 1, wherein changing between the first state and the second state of the at least one contact changes a state of an electrical device located within the enclosure, wherein the enclosure is an explosion-proof enclosure.

14. An enclosure, comprising:

an enclosure surface having a front side and a back side;

a control device disposed proximate to the enclosure surface, wherein the control device comprises:

a first portion positioned proximate to the back side of an enclosure surface of the enclosure, wherein the first portion comprises:

a plunger comprising a proximal end and a distal end, wherein the plunger has a first position toward the enclosure surface and a second position away from the enclosure surface, and wherein the proximal end is adjacent to the enclosure surface;

a first magnet having a first polarity and disposed at the proximal end of the plunger; and at least one contact in communication with the distal end of the plunger, wherein the at least one contact has a first state and a second state; and a second portion positioned on the front side of the enclosure surface opposite the first portion on the back side of the enclosure, wherein the second portion comprises:

a receiving feature positioned on the front side of the enclosure surface; and a second magnet removably disposed within the receiving feature, wherein the second magnet has a first side and a second side opposite the first side, wherein the first side has the first polarity, wherein the second side has a second polarity that opposes the first polarity, wherein the second magnet is in an engaged position when the first side is positioned proximate to the front side of the enclosure surface, and wherein the second magnet is in a disengaged position when the second side is positioned proximate to the front side of the enclosure surface, wherein the second magnet, when in the engaged position, generates a first magnetic force with the first magnet, wherein the first magnetic force moves the plunger to force the contact into the first state, and wherein the second magnet, when in the disengaged position, generates a second magnetic force, wherein the second magnetic force moves the plunger to force the contact into the second state.

15. The enclosure of claim 14, wherein the enclosure surface is among a plurality of enclosure surfaces, wherein the plurality of enclosure surfaces comply with at least one standard for an explosion-proof enclosure.

16. The enclosure of claim 14, wherein the enclosure surface is a cover of the enclosure.

17. The enclosure of claim 14, wherein the enclosure surface lacks an aperture traversed by the control device.

18. A control device for an enclosure, the control device comprising:

a first portion positioned proximate to a back side of an enclosure surface of the enclosure, wherein the first portion comprises:

a plunger comprising a proximal end and a distal end, wherein the plunger has a first position toward the enclosure surface and a second position away from the enclosure surface, and wherein the proximal end is adjacent to the enclosure surface;

a first magnet having a first polarity and disposed at the proximal end of the plunger; and at least one contact in communication with the distal end of the plunger, wherein the at least one contact has a first state and a second state; and a second portion positioned on a front side of the enclosure surface opposite the first portion on the back side of the enclosure, wherein the second portion comprises:

a receiving feature positioned on the front side of the enclosure surface; and a second magnet removably disposed within the receiving feature, wherein the second magnet is in an engaged position when the second magnet is disposed, irrespective of either polar orientation of the second magnet, within the receiving feature, and wherein the second magnet is in a disengaged position when the second magnet is removed from the receiving feature, wherein the second magnet, when in the engaged position, generates a magnetic force with the first magnet, wherein the magnetic force moves the plunger to force the contact into the first state, and wherein the second magnet, when in the disengaged position, removes the magnetic force, wherein removal of the magnetic force moves the plunger to force the contact into the second state.

19. The control device of claim 18, wherein the second magnet has the first polarity, wherein the second magnet repels the first magnet when the second magnet is in the engaged position.

20. The control device of claim 18, wherein the second magnet has a second polarity that opposes the first polarity, wherein the second magnet attracts the first magnet when the second magnet is in the engaged position.

* * * * *